US010806322B2

(12) United States Patent
Dirnberger et al.

(10) Patent No.: US 10,806,322 B2
(45) Date of Patent: Oct. 20, 2020

(54) DOOR LATCH FOR A DOMESTIC ELECTRICAL APPLIANCE

(71) Applicant: emz-Hanauer GmbH & Co. KGaA, Nabburg (DE)

(72) Inventors: Albert Dirnberger, Neunburg vorm Wald (DE); Dominik Walz, Nabburg (DE); Markus Lang, Neunburg vorm Wald (DE)

( * ) Notice: Subject to any disclaimer, the term of this patent is extended or adjusted under 35 U.S.C. 154(b) by 681 days.

(21) Appl. No.: 15/643,018

(22) Filed: Jul. 6, 2017

(65) Prior Publication Data

US 2018/0008120 A1 Jan. 11, 2018

(30) Foreign Application Priority Data

Jul. 7, 2016 (DE) ..... 10 2016 008 317

(51) Int. Cl.
*A47L 15/42* (2006.01)
*D06F 37/42* (2006.01)
(Continued)

(52) U.S. Cl.
CPC ..... *A47L 15/4259* (2013.01); *D06F 37/42* (2013.01); *E05B 47/0603* (2013.01);
(Continued)

(58) Field of Classification Search
CPC ..... Y10T 292/1047; Y10T 292/1092; Y10T 292/1082; Y10T 292/1043; D06F 37/42;
(Continued)

(56) References Cited

U.S. PATENT DOCUMENTS 3,667,793 A * 6/1972 Varrin et al. ..... E05C 3/24 292/216
3,890,813 A * 6/1975 Cothron ..... E05B 47/0607 70/92
(Continued)

FOREIGN PATENT DOCUMENTS

EP 1 544 387 B1 12/2010
EP 2 367 997 B1 5/2013
(Continued)

OTHER PUBLICATIONS

German search report co-pending application DE 10 2016 008 317.4; dated Jan. 11, 2017.

*Primary Examiner* — Kristina R Fulton
*Assistant Examiner* — Faria F Ahmad
(74) *Attorney, Agent, or Firm* — Sarita L. Pickett; Robert Deleault; Mesmer & Deleault, PLLC

(57) ABSTRACT

A door latch for a domestic electrical appliance includes a latch assembly that includes a locking element arranged to be displaceable between an unlocking position and a locking position, and an arresting element which moves from its release position into the arresting position as the door is closed. The arresting element in the arresting position can be locked by means of the locking element against movement into the release position and in the locked state prevents the closed door from opening. The latch assembly further includes an electric switch which, when the door is closed, responds to a movement of the locking element from the unlocking position into the locking position, and a switch auxiliary control member which, as the door is closed, is urged by the closing body from an active position against a restoring spring force into an inactive position.

11 Claims, 9 Drawing Sheets

(51) Int. Cl.

| | |
|---|---|
| ***E05C 3/14*** | (2006.01) |
| ***E05C 19/02*** | (2006.01) |
| ***E05B 47/06*** | (2006.01) |
| ***E05C 3/24*** | (2006.01) |
| ***D06F 39/14*** | (2006.01) |
| ***E05B 17/00*** | (2006.01) |
| ***E05C 5/00*** | (2006.01) |
| ***E05B 47/00*** | (2006.01) |
| ***E05B 17/20*** | (2006.01) |

(52) U.S. Cl.
CPC ..... *E05C 3/14* (2013.01); *E05C 3/24* (2013.01); *E05C 19/022* (2013.01); *D06F 39/14* (2013.01); *E05B 17/0025* (2013.01); *E05B 17/2092* (2013.01); *E05B 2047/0068* (2013.01); *E05C 5/00* (2013.01); *Y10S 292/69* (2013.01); *Y10T 292/1043* (2015.04); *Y10T 292/1047* (2015.04); *Y10T 292/1082* (2015.04); *Y10T 292/1092* (2015.04)

(58) Field of Classification Search
CPC ..... D06F 39/14; A47L 15/4259; E05B 2047/0068; E05B 47/0603; E05B 17/0025; E05B 17/2092; E05C 5/00; E05C 3/14; E05C 3/24; Y10S 292/69
See application file for complete search history.

(56) References Cited

U.S. PATENT DOCUMENTS 4,620,735 A * 11/1986 Heydner ..... D06F 37/42 200/50.1
4,988,132 A * 1/1991 Rocchitelli ..... D06F 37/42 292/144
5,062,668 A * 11/1991 Onderka ..... F16P 3/10 200/61.64
5,520,424 A * 5/1996 Hapke ..... D06F 37/42 292/198
5,691,520 A * 11/1997 Hapke ..... D06F 37/42 200/61.62
6,082,787 A * 7/2000 Chioffi ..... D06F 37/42 292/128
6,290,270 B1 * 9/2001 Spiessl ..... E05C 3/24 292/216
6,315,336 B1 * 11/2001 Swartzell ..... E05B 47/0012 292/201
6,363,755 B1 * 4/2002 Hapke ..... D06F 37/42 210/146
6,634,684 B2 * 10/2003 Spiessl ..... D06F 37/42 134/57 DL
8,109,543 B2 * 2/2012 Chirumbolo ..... E05B 17/0033 292/201
8,276,951 B2 * 10/2012 Dirnberger ..... D05C 3/24 292/336
8,736,406 B2 5/2014 Hapke et al.
9,469,932 B2 * 10/2016 Rocchitelli ..... D06F 37/28
9,487,907 B2 * 11/2016 Hapke ..... D06F 39/14
2002/0163206 A1 * 11/2002 Bass ..... B66B 13/04 292/192
2003/0127866 A1 * 7/2003 Martinez ..... E05B 17/0029 292/216
2003/0197387 A1 * 10/2003 Dirnberger ..... E05B 17/22 292/216
2005/0121918 A1 * 6/2005 Smock ..... F24C 15/022 292/109
2005/0194795 A1 * 9/2005 Hapke ..... D06F 39/14 292/216
2006/0033346 A1 * 2/2006 Ala ..... A47L 15/4259 292/216
2006/0208502 A1 * 9/2006 Parent ..... E05B 81/14 292/216
2006/0261603 A1 * 11/2006 Cetnar ..... E05B 77/06 292/216
2006/0267350 A1 * 11/2006 Ichinose ..... E05B 81/64 292/201
2007/0144880 A1 * 6/2007 Bragg ..... D06F 37/42 200/50.02
2008/0169657 A1 * 7/2008 Horton ..... E05B 83/30 292/220
2009/0072547 A1 * 3/2009 Dirnberger ..... E05C 3/24 292/85
2011/0214460 A1 * 9/2011 Byun ..... E05B 81/00 70/91
2012/0292924 A1 * 11/2012 Promutico ..... D06F 37/28 292/113
2015/0225886 A1 * 8/2015 Rocchitelli ..... D06F 37/28 292/38
2015/0238065 A1 * 8/2015 Osvatic ..... E05C 19/024 49/394
2016/0138809 A1 * 5/2016 Colucci ..... E05C 19/00 292/122
2017/0067270 A1 * 3/2017 Lang ..... D06F 37/28
2017/0362766 A1 * 12/2017 Cho ..... E05C 19/022
2019/0017216 A1 * 1/2019 Dirnberger ..... E05B 47/0607

FOREIGN PATENT DOCUMENTS

EP 1 975 300 B1 8/2015
WO 2011109235 A1 9/2011

* cited by examiner

DOOR LATCH FOR A DOMESTIC ELECTRICAL APPLIANCE

BACKGROUND OF THE INVENTION

1. Field of the Invention

The present invention relates generally to a door latch for a domestic electrical appliance, where the domestic appliance may be, for example, a laundry treatment appliance or an electric oven. The laundry treatment appliance may be a washing machine or a laundry drier.

2. Description of the Prior Art

Some domestic electrical appliances have a door latch which has a so-called interlock switch which changes its switch state when the latch is locked. The change in the switch state can be detected by an electric/electronic circuit of the domestic appliance in order, for example, to start a programme run of the domestic appliance (e.g. a wash programme or a pyrolysis operation) in dependence on the detection of the change in the switch state. Locking of the domestic appliance is effected by the movement of a locking element from an unlocking position into a locking position, in which the locking element blocks an arresting element in an arresting position against movement into a release position. The arresting element in turn moves from the release position into the arresting position as the door of the domestic appliance is closed; as soon as it is locked in the arresting position by the locking element, the door can no longer be opened without the use of force.

However, it may nevertheless be possible to open the door in the locked state by force, generally with damage to the door latch. If the door is opened by force in that manner while an operating programme of the domestic appliance is running, it is desirable for safety reasons to force the programme run to stop. Measures are known from EP 1 544 387 B1 and WO 2011/109235 A1 to enforce a change in the switch state of an interlock switch in the event that the locked door is opened by force.

SUMMARY OF THE INVENTION

The present invention starts from a door latch for a domestic electrical appliance that includes a latch assembly which is configured to hold a closing body in place for holding a door of the domestic appliance closed and to release the closing body for opening of the door. The latch assembly includes a locking element which is arranged to be displaceable between an unlocking position and a locking position, an arresting element which is arranged to be movable between a release position and an arresting position and which moves from its release position into the arresting position as the door is closed where the arresting element in the arresting position can be locked by means of the locking element against movement into the release position and in the locked state prevents the closed door from opening, an electric switch which, when the door is closed, responds to a movement of the locking element from the unlocking position into the locking position, and a switch auxiliary control member which is arranged to be movable and which, as the door is closed, is urged by the closing body from an active position against a restoring spring force into an inactive position where the switch auxiliary control member in the active position enforces a first switch state of the electric switch and in the inactive position permits a change in the switch state of the electric switch.

According to the present invention, it is provided in such a door latch that the switch auxiliary control member is formed by a slider component which is arranged to be linearly displaceable between the active position and the inactive position. A form of the switch auxiliary control member as a linearly movable slider component can be advantageous in terms of the installation space available in the domestic appliance for accommodating the door latch, in particular if the switch auxiliary control member is arranged to be displaceable in a plane transverse, for example substantially perpendicular, to a direction in which the closing body enters the latch assembly as the door is closed. The depth of the installation space that is present in said direction is often limited; by contrast, there is often sufficient installation space in a transverse plane thereto.

In some embodiments, the switch auxiliary control member in the active position acts via the locking element on a contact element, in particular a leaf spring, forming an electric switch contact of the electric switch. In these embodiments, when the switch auxiliary control member is displaced from the inactive position into the active position, it causes the locking element to be transferred from the locking position into the unlocking position. This is accompanied by a change in the switch state of the electric switch. In other embodiments, the switch auxiliary control member in the active position acts, bypassing the locking element, on a contact element, for example a leaf spring, forming an electric switch contact of the electric switch. In these embodiments, the locking element can remain unaffected by a displacement of the switch auxiliary control member from the inactive position into the active position. Accordingly, the arresting element can remain locked despite a change in the switch state of the electric switch brought about by the displacement of the switch auxiliary control member.

In some embodiments, the switch auxiliary control member has a control path for a ramp follower which influences the switch state of the electric switch, where the control path forms an ascending control ramp, as seen in the movement direction of the switch auxiliary control member. This configuration of the switch auxiliary control member can be chosen independently of the form of the switch auxiliary control member as a linearly displaceable slide component. For example, the configuration with a control path and a control ramp can also be used when the switch auxiliary control member is a pivotably mounted rotary component. By means of the control ramp, the movement of the switch auxiliary control member can be converted into a movement of the ramp follower oriented transversely thereto. This creates freedom of choice in terms of the arrangement of the various components of the latch assembly within the available installation space.

The control path can form a first path plateau adjacent to an upper ramp end of the control ramp. If desired, the control ramp can also form a further, second path plateau adjacent to a lower ramp end of the control ramp.

The ramp follower can be formed by the locking element. Alternatively—as already discussed above—the switch auxiliary control member, bypassing the locking element, can act on a contact element of the electric switch. In this case, the ramp follower can be formed, for example, directly by the contact element of the electric switch. Alternatively, the ramp follower can be formed by a pusher which is separate from the locking element and which cooperates with a contact element, for example a leaf spring, forming an electric switch contact of the electric switch.

In some embodiments, the latch assembly comprises a gripper which is displaceable, while executing a rotational movement, between a release position and a gripping position and which in the gripping position engages behind the closing body in order to hold the door closed and in the release position releases the closing body in order to open the door. The arresting element in its arresting position prevents the gripper from being transferred to the release position. The arresting element can be a slider component which is arranged to be linearly displaceable or a rotary component which is arranged to be rotatable. For a possible configuration of the arresting element, reference is made to DE 10 2015 002 538 B3 and the blocking slide 124 described therein in connection with FIGS. 4 to 8, which reference is incorporated herein by reference.

The solution according to the present invention is suitable in particular, but not exclusively, for configurations of the door latch without a so-called door switch, that is to say without an electric switch which responds to the closing of the door and can accordingly signal the closed state of the door to a control unit of the domestic appliance.

The present invention will be described in greater detail below with reference to the accompanying drawings, which are to be understood as schematic sketches rather than detailed reproductions of concrete embodiments.

DETAILED DESCRIPTION OF THE PRESENT INVENTION

Figure 1:
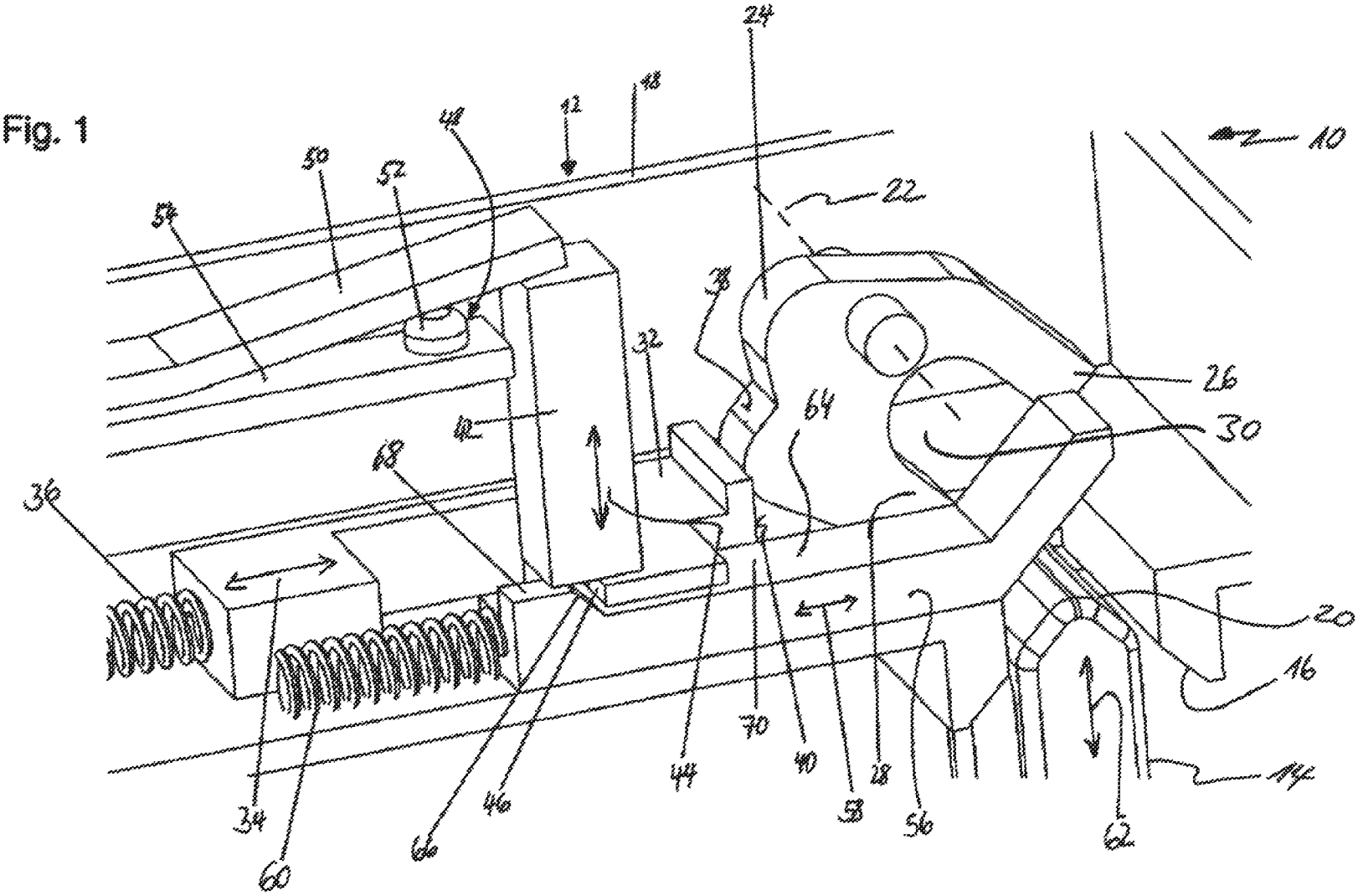
FIG. 1 shows components of a door latch according to a first embodiment, showing the situation in which the door of a domestic appliance equipped with the door latch is not yet closed.

Reference will first be made to the first embodiment according to FIGS. 1 to 3. The door latch shown therein is generally designated 10. It serves to hold closed and lock a door of a domestic electrical appliance, which can be, for example, a washing machine or an electric oven. The door serves to close an access opening to a treatment chamber of the domestic appliance. Neither the door nor the domestic appliance as such are shown in detail in the drawings; because they are conventional components, they are generally known to the average person skilled in the art.

The door latch 10 comprises as fundamental components a latch assembly 12 and a closing body 14. One of these fundamental components, for example the closing body 14, is mounted on the door of the domestic appliance, while the other component, for example the latch assembly 12, is mounted on a main part of the domestic appliance containing the treatment chamber. As the door is closed, the closing body 14 moves into an introduction opening 16 formed in a latch housing 18 of the latch assembly 12. The closing body 14 forms a leading stirrup-like portion 20 which, as the door is closed, is captured by a gripper 24 which is mounted to be rotatable relative to the latch housing 18 about an axis of rotation 22. In the example shown, the gripper 24 forms a gripping jaw 30 delimited by two cheeks 26, 28, the stirrup portion 20 of the closing body 14 entering the gripping jaw as the door is closed. It thereby strikes one of the cheeks (here cheek 26) of the gripping jaw 30, which initiates a rotational movement of the gripper 24 about the axis of rotation 22. In the course of this rotational movement, the other cheek (here cheek 28) of the gripping jaw 30 passes behind the stirrup portion 20, so that it is captured between the two cheeks 26, 28. FIG. 1 shows the gripper 24 in a release position, which it assumes when the door is open. After the door has closed, the gripper 24 assumes the gripping position shown in FIG. 2. The transition from the release position to the gripping position can be superimposed by a translational movement of the gripper 24 in addition to the mentioned rotational movement.

Associated with the gripper 24 is an arresting element 32 which, in the example shown, is in the form of a linearly movable slider component and is referred to hereinbelow as the main slider. The sliding direction of the main slider 32 is indicated in the drawings by a double-headed arrow 34 and runs parallel to the rotation plane of the gripper 24. The main slider is displaceable between a release position shown in FIG. 1 and an arresting position shown in FIG. 2. The main slider 32 is spring-pretensioned towards the gripper 24 by means of a spring element 36 which, in the example shown, is in the form of a helical compression spring. As the door is closed, the main slider 32 moves from the release position into the arresting position. If the gripper 34 has reached its gripping position, the main slider 32 abuts a blocking face 38 of the gripper 34. The engagement of the main slider 32 with the gripper 34 when the door is closed (according to FIG. 2) is depicted in the example shown as a butt joint, that is to say two faces, specifically the blocking face 38 of the gripper and an opposite stop face 40 of the main slider 32, are in this state in flat contact with one another with an orientation perpendicular to the displacement direction 34.

Figure 2:
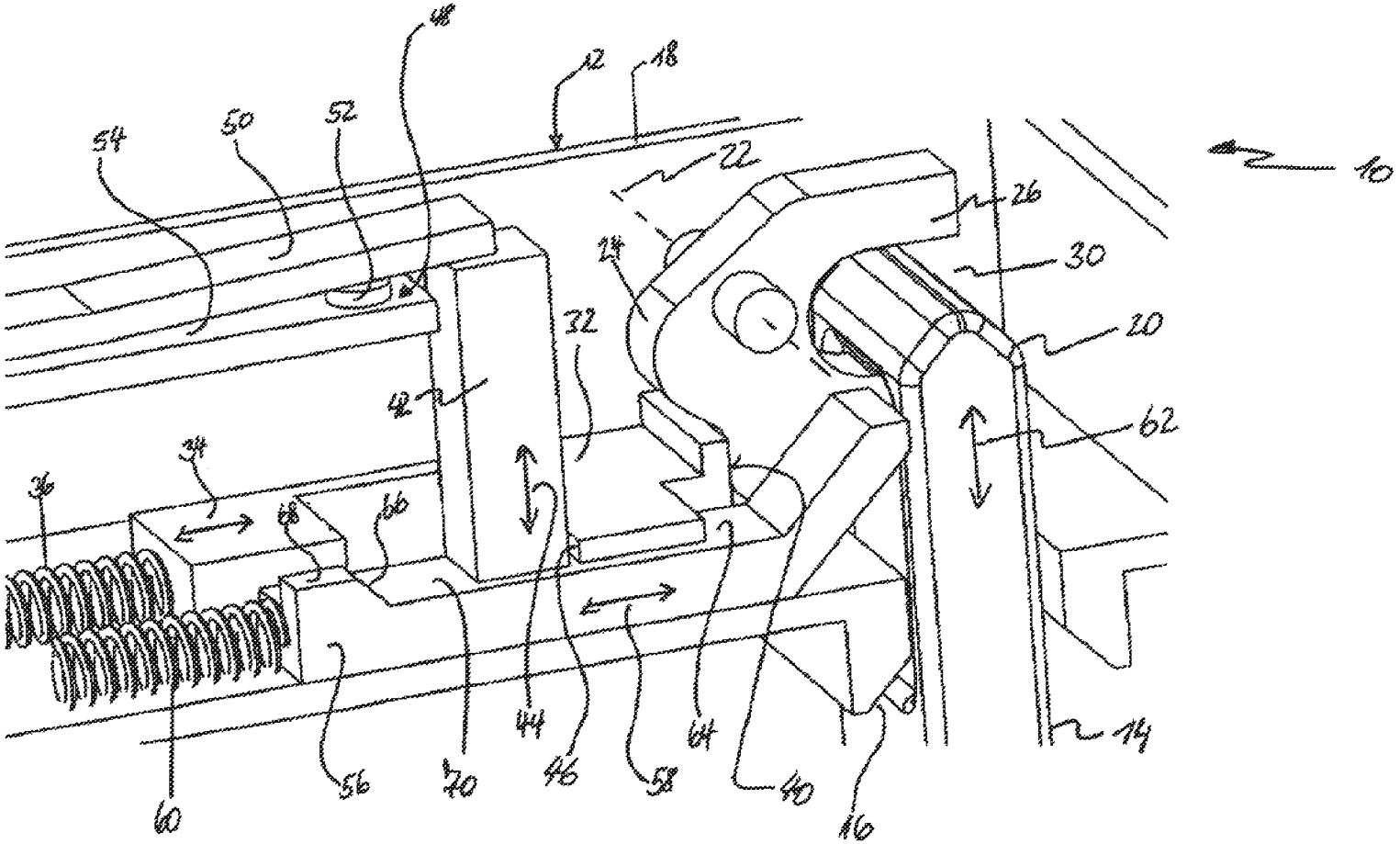
FIG. 2 shows the door latch of FIG. 1 in a situation in which the door is closed.

In its arresting position according to FIG. 2, the main slider 32 can be locked, that is to say stopped from moving away from the gripper 24 out of the arresting position, by a locking element 42, which is here in the form of a locking pin. The locking pin 42 is arranged to be displaceable by means of an actuator (not shown), which can be, for example, an electromagnetic actuator, in a linear displacement direction indicated by a double-headed arrow 44 between an unlocking position shown in FIG. 1 and a locking position shown in FIG. 2. The main slider 32 has a blocking edge 46 which, when the main slider 32 is in the release position, is situated beneath the locking pin 42 and thus prevents the locking pin 42 from being transferred from the unlocking position to the locking position. When the main slider 32 moves from the release position according to FIG. 1 into the arresting position according to FIG. 2, the blocking edge 46 moves out of the movement range of the locking pin 42, so that, when the main slider 32 is in the arresting position, the locking pin 42 can be brought into its locking position according to FIG. 2. In this state, the locking pin 42 prevents the main slider 32 from receding, that is to say prevents the main slider 32 from moving away from the gripper 24. The gripper 24 is thereby also stopped from rotating back into the release position; the door latch 10 is in a locked state.

An electric switch 48, called the locking switch for short hereinbelow, serves to detect the locking state of the door latch 10. In the example shown, the locking switch 48 is a switch which is electrically open in the unlocked state of the door latch 10 and electrically closed in the locked state of the door latch 10. It will be appreciated that the reverse configuration may also be chosen in other embodiments. The locking switch 48 is mechanically coupled with the locking pin 42 or with the mentioned actuator for the locking pin 42 so that, when the locking pin 42 is transferred from the unlocking position to the locking position, the switch state of the locking switch 48 also changes (in the example shown from open to closed). In the example shown, the locking pin 42 cooperates with a resiliently deflectable leaf spring element 50 which forms one of two switch contacts of the locking switch 48. The other switch contact is formed by a contact lug 52 which is arranged on a fixedly arranged metal strip 54. The open switch state of the locking switch 48 is characterised in that a free end portion of the leaf spring element 50 is lifted from the contact lug 52; in the closed state of the locking switch 48, on the other hand, said free end portion of the leaf spring element 50 rests on the contact lug 52, so that a flow of current from the leaf spring element 50 via the contact lug 52 to the metal strip 54 is possible.

In the example shown, the locking pin 42 is so arranged that it cooperates with the free end portion of the leaf spring element 50. In concrete terms, it lifts the free end portion of the leaf spring element 50 out of contact with the contact lug 52 in the unlocking position. Upon transfer to the locking position, the locking pin 42 descends to such an extent (for example owing to the inherent spring tension of the leaf spring element 50) that the locking switch 48 closes.

The locking switch 48 is electrically coupled with a control unit (not shown) of the domestic appliance. If the control unit receives, via the locking switch 48, a signal that the door latch 10 is locked, it starts a programme run, for example a wash programme of a washing machine, in a manner known per se. It may be that a user then attempts to open the door by force while the programme is running. If sufficiently high force is applied, the cheek 28 of the gripper 24 engaging behind the stirrup portion 20 of the closing body 14 can in some circumstances tear off. This case is shown in FIG. 3. If the cheek 28 breaks off, the closing body 14 can be pulled out of the latch assembly 12 and the door can accordingly be opened, without there being an associated change in the rotational position of the gripper 24. The gripper remains in its gripping position, because it was prevented from rotating by the locked main slider 32 during the operation of opening the door by force.

In order nevertheless to allow the programme run to be stopped immediately, the latch assembly 12 has an auxiliary slider 56 (or switch auxiliary control member 56) which is separate from the main slider 32 and is movable independently of the main slider 32 and which forms a the switch auxiliary control member within the meaning of the invention and is linearly displaceable in a movement direction indicated by a double-headed arrow 58. The auxiliary slider 56 is displaceable in the movement direction 58 between an active position shown in FIG. 1 and an inactive position shown in FIG. 2. As the door is closed, the closing body 14 abuts the auxiliary slider 56 and presses it against the force of a spring element 60, which is shown here in the form of a helical compression spring, from the active position into the inactive position. The movement direction 58 of the auxiliary slider 56 runs in a plane substantially perpendicular to a movement direction of the closing body 14 indicated by a double-headed arrow 62 in the region of the introduction opening 16 as the door is opened and closed. The door is generally attached in an articulated manner to the main part of the domestic appliance, that is to say the door performs a pivoting movement as it opens and closes. When viewed over a small angle range, however, the movement of the door and consequently of the closing body 14 can be described in good approximation by a linear movement direction. The double-headed arrow 62 describes the movement direction followed by the closing body 14 when it is situated in the region of the introduction opening 16. The movement direction 58 of the auxiliary slider 56 runs substantially perpendicularly to that movement direction 62. At the same time, the movement direction 58 of the auxiliary slider 56 also runs perpendicularly to the axis of rotation 22 of the gripper 24. It will be appreciated that the movement directions 34 and 58, which in the example shown are parallel to one another, can run at an angle to one another in other embodiments.

Figure 3:
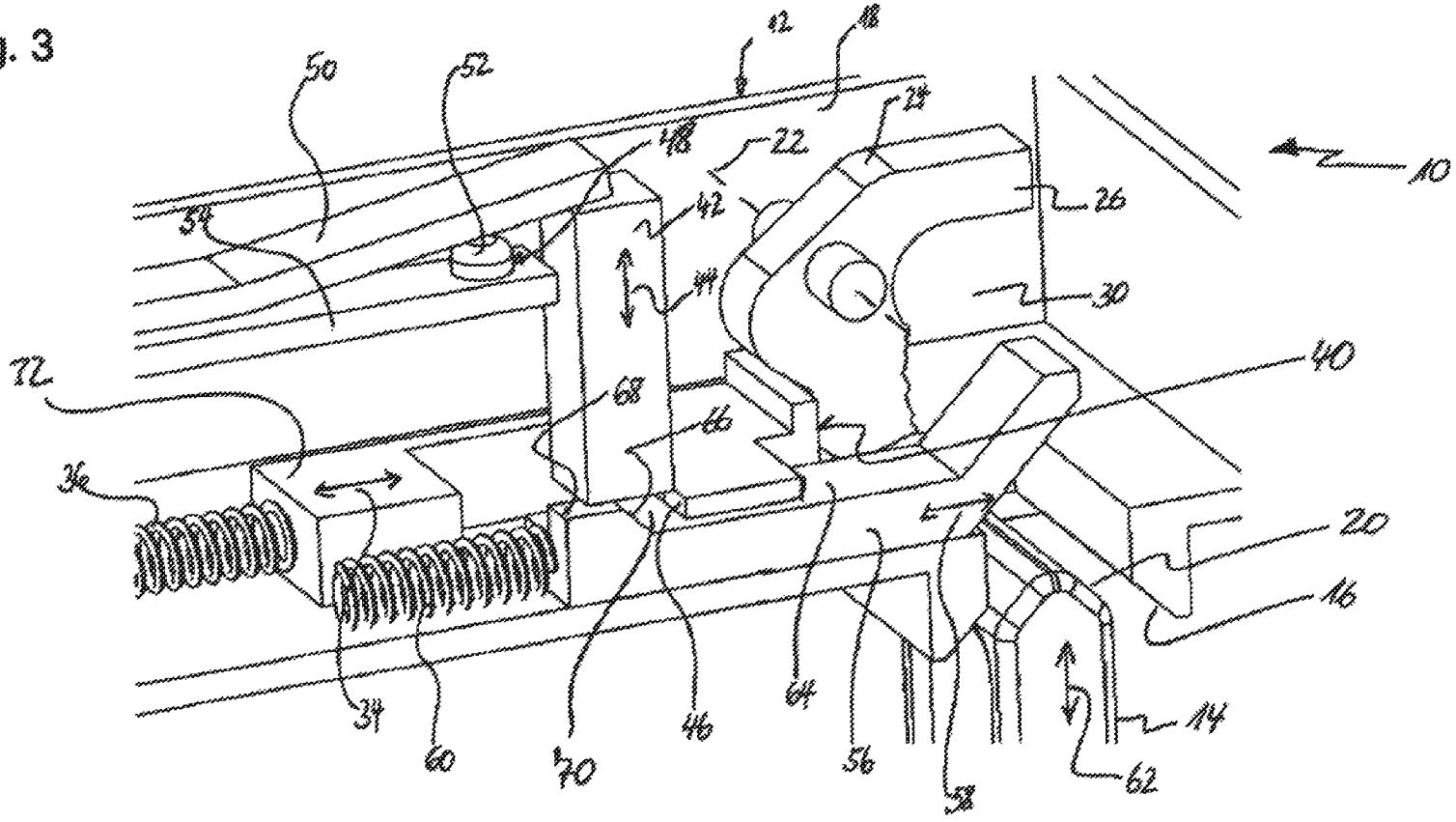
FIG. 3 shows the door latch of FIG. 1 in a situation after the door has been opened by force.

The auxiliary slider 56 forms, on its upper slider side in the view of FIGS. 1 to 3, a control path 64 which, as a path portion, forms a control ramp 66 ascending in the movement direction 58. At the upper end of the control ramp 66, the control path 64 forms an upper path plateau 68, and at the lower end of the control ramp 66 it forms a lower path plateau 70. The locking pin 42 is situated with a portion of its pin cross-section above the control path 64 and is controllable thereby. When the door is open, that is to say when the auxiliary slider 56 is in the active position and the locking pin 42 is in the unlocking position (according to FIG. 1), the upper path plateau 68 lies beneath the locking pin 42. Even if the main slider 32 were moved in this state into its arresting position, the locking pin 42 would still not be able to move into its locking position because it would be prevented from doing so by the upper path plateau 68 of the control path 64.

In the inactive position of the auxiliary slider 56, which it assumes after the door has closed (according to FIG. 2), both the upper path plateau 68 and the control ramp 66 are removed from the movement path of the locking pin 42; the locking pin 42 is situated solely above the lower path plateau 70 of the control path 64. The lower path plateau 70 has a height level which allows the locking pin 42 to be transferred from the unlocking position to the locking position. In other words, the auxiliary slider 56, in the inactive position, does not stop the locking pin 42 from being transferred to the locking position.

If the situation then occurs in which the door is opened by force and at the same time the gripper 24 is damaged (the cheek 28 breaks off), the auxiliary slider 56 is again free to move back from the inactive position into the active position. Provided that the spring element 60 has a sufficient spring force, the spring element 60 is able to urge the auxiliary slider 56 back into the active position. During this movement of the auxiliary slider 56, the control ramp 66 moves beneath the locking pin 42. The locking pin 42 correspondingly moves upwards along the control ramp 66 until it reaches the upper path plateau 68. Consequently, the control ramp 66 causes the locking pin 42 to be lifted against the inherent spring tension of the leaf spring element 50. The locking switch 48 is opened in this manner. The main slider 32 remains unchanged in its arresting position during this operation. The control ramp 66 is advantageously sufficiently high to lift the control pin 42 into a position in which it is no longer in front of the blocking edge 46 of the main slider 32 and accordingly the main slider 32 is no longer locked by the locking pin 42. The forced opening of the locking switch 48 by means of the auxiliary slider 56 is detected by the control unit of the domestic appliance and can be converted by the control unit into an immediate stopping of the programme run.

In the further figures, components which are the same or have the same effect are provided with the same reference numerals as hereinbefore, but with the addition of a lower-case letter. Unless indicated otherwise hereinbelow, reference is made to the above observations relating to FIGS. 1 to 3 for the explanation of such components.

Figure 4:
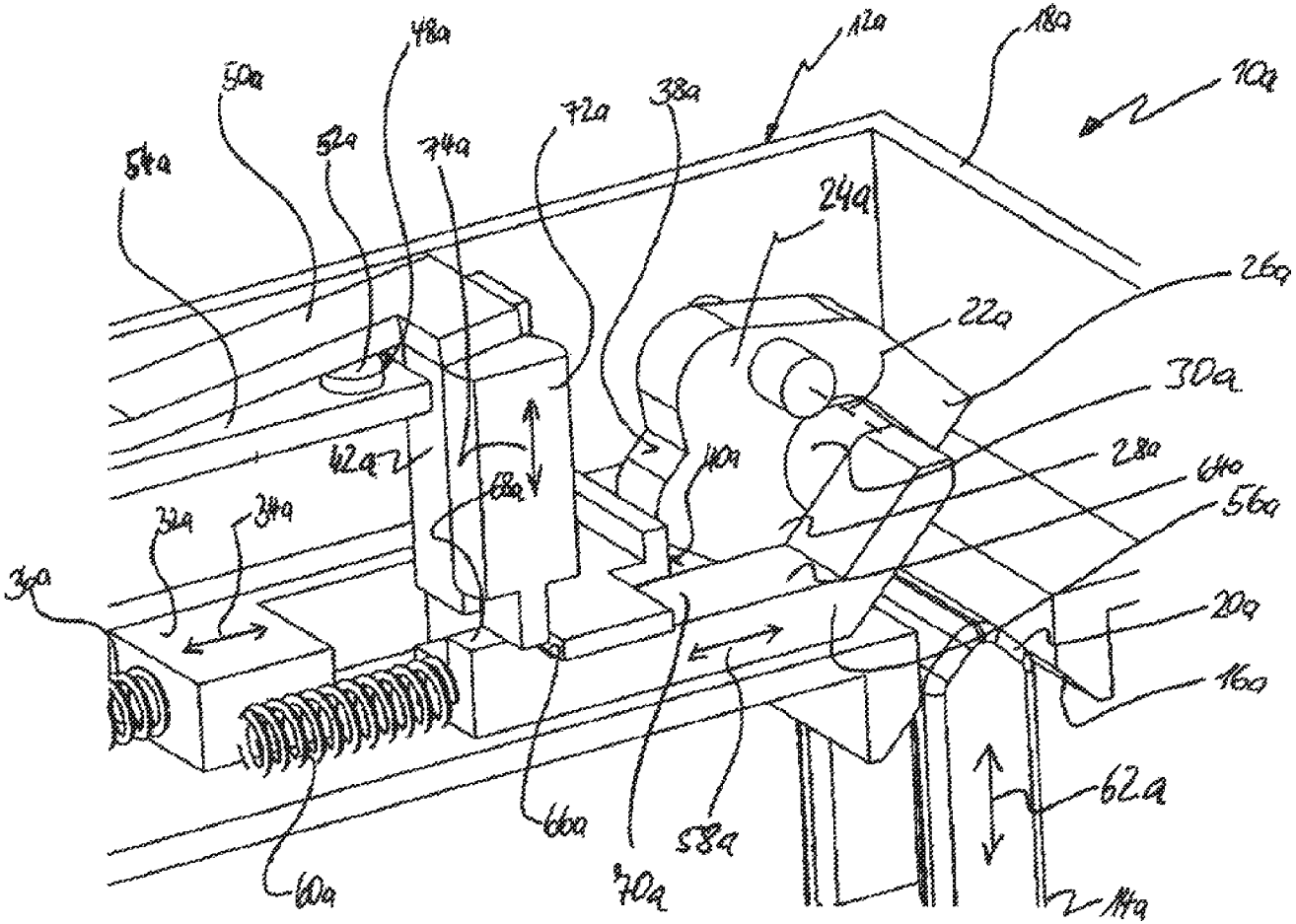
FIG. 4 shows components of a door latch according to a second embodiment, in a situation corresponding to FIG. 1.
Figure 5:
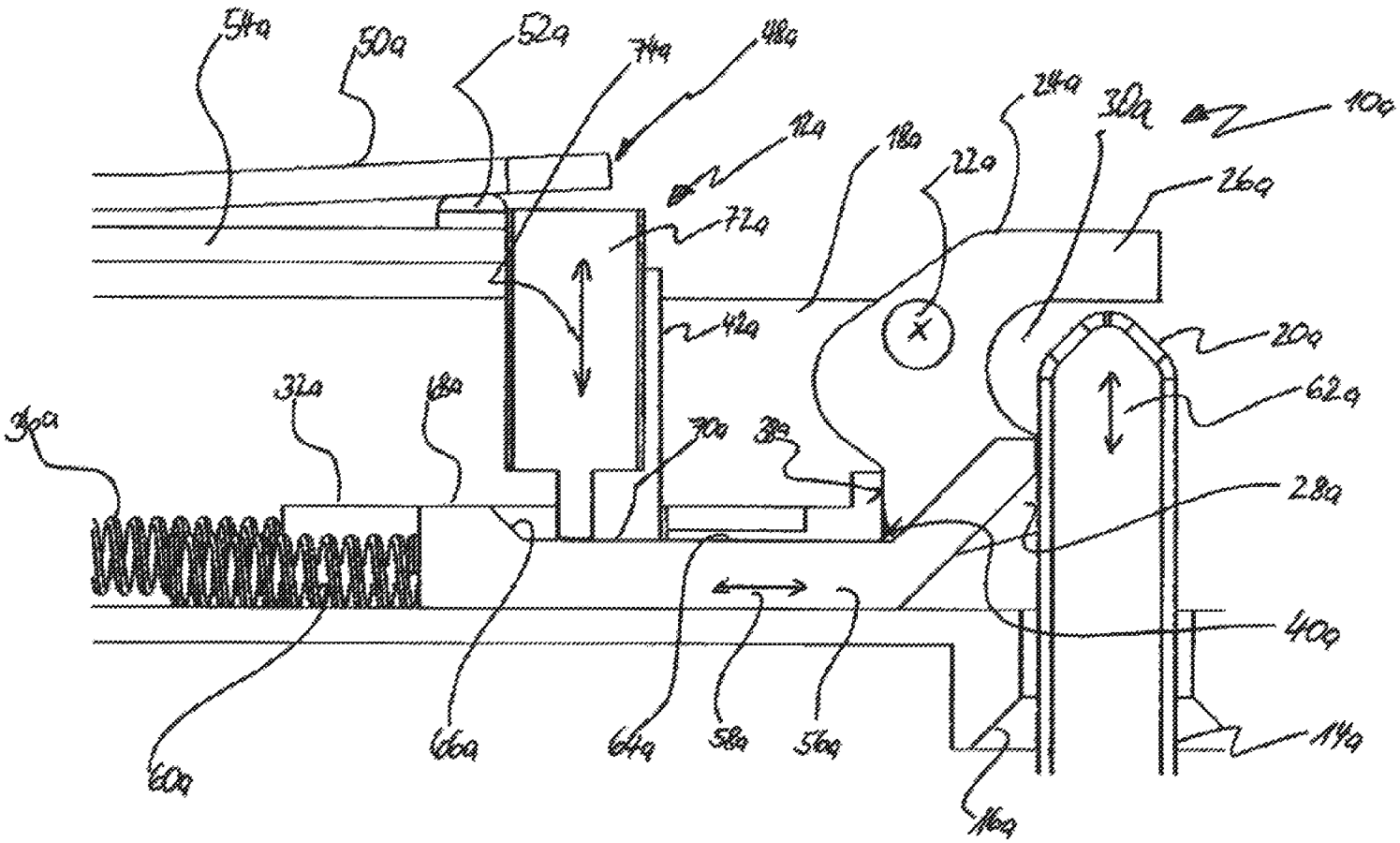
FIG. 5 shows the door latch of FIG. 4 in a situation corresponding to FIG. 2.
Figure 6:
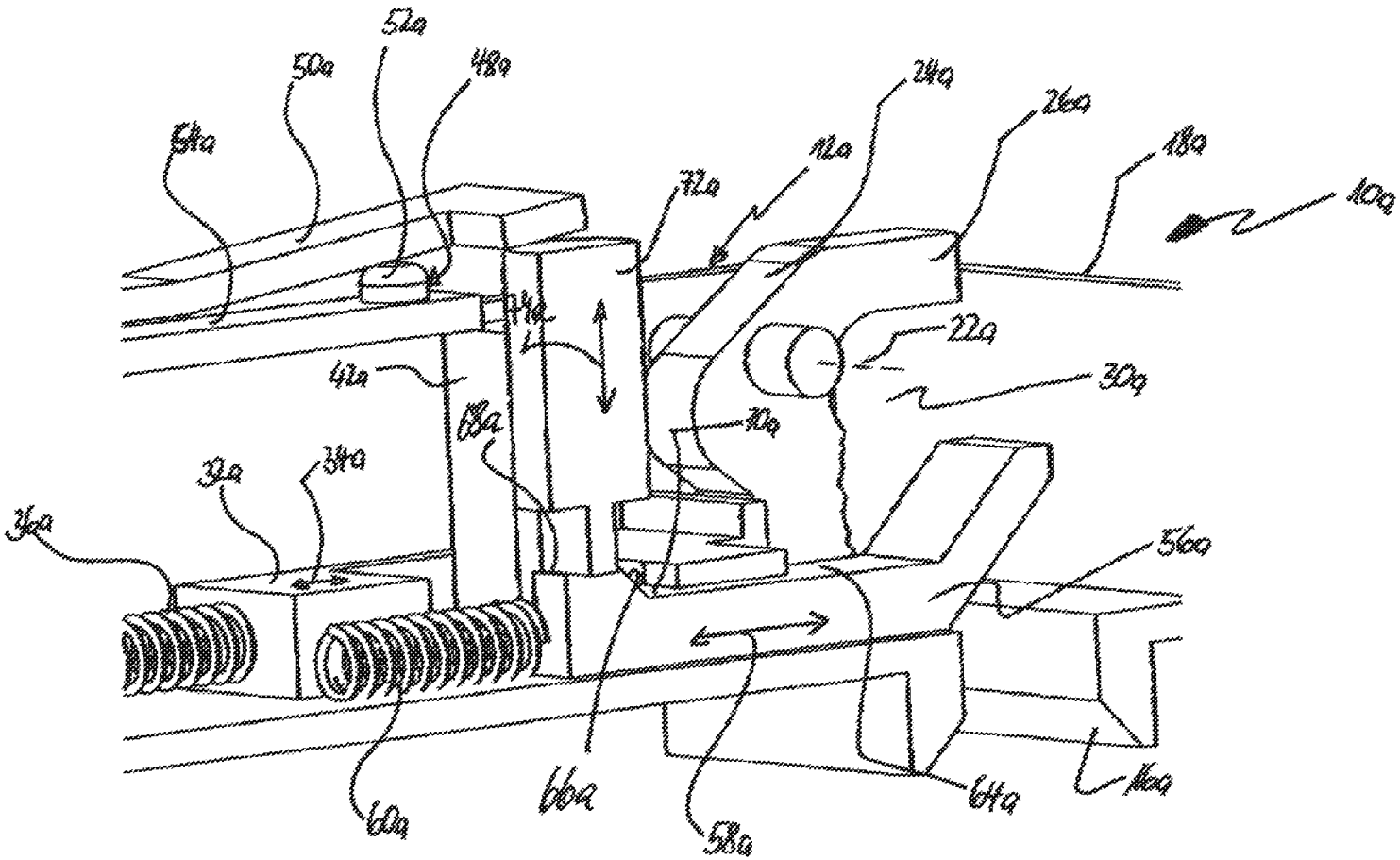
FIG. 6 shows the door latch of FIG. 4 in a situation corresponding to FIG. 3.

The second embodiment according to FIGS. 4 to 6 differs from the first embodiment substantially in that the auxiliary slider 56*a* acts not via the locking pin 42*a* but instead, bypassing the locking pin 42*a*, on the locking switch 48*a*. The position of the locking pin 42*a* is accordingly at no time controlled by the control path 64*a* of the auxiliary slider 56*a*. On the other hand, for actuating the locking switch 48*a* there is provided a pusher 72*a* which is separate from the locking pin 42*a* and movable independently thereof, which pusher follows the trajectory of the control path 64*a* and is movable up and down in a movement direction, indicated by a double-headed arrow 74*a*, perpendicular to the movement direction 58*a* of the auxiliary slider 56*a*. The leaf spring element 50*a* of the locking switch 48*a* is sufficiently wide in the region of its free end portion that it can be engaged not only by the locking pin 42*a* but also by the pusher 72*a* and lifted out of contact with the contact element 52*a*.

When the door is open, the pusher 72*a* is situated above the upper path plateau 68*a* of the control path 64*a* and, as the door is closed, slides down the control ramp 66*a* onto the lower path plateau 70*a*, while the auxiliary slider 56*a* is displaced from the active position into the inactive position (FIGS. 4 and 5). If the door is opened by force (FIG. 6), the auxiliary slider 56*a* slides back into the active position under the force of the spring element 60*a*. The pusher 72*a* thereby slides up the control ramp 66*a* and reaches the upper path plateau 68*a*. This is accompanied by lifting of the leaf spring element 50*a* out of contact with the contact element 52*a*—the locking switch 48*a* is opened. The locking pin 42*a* remains unaffected during this operation, that is to say it remains in its locking position.

Figure 7:
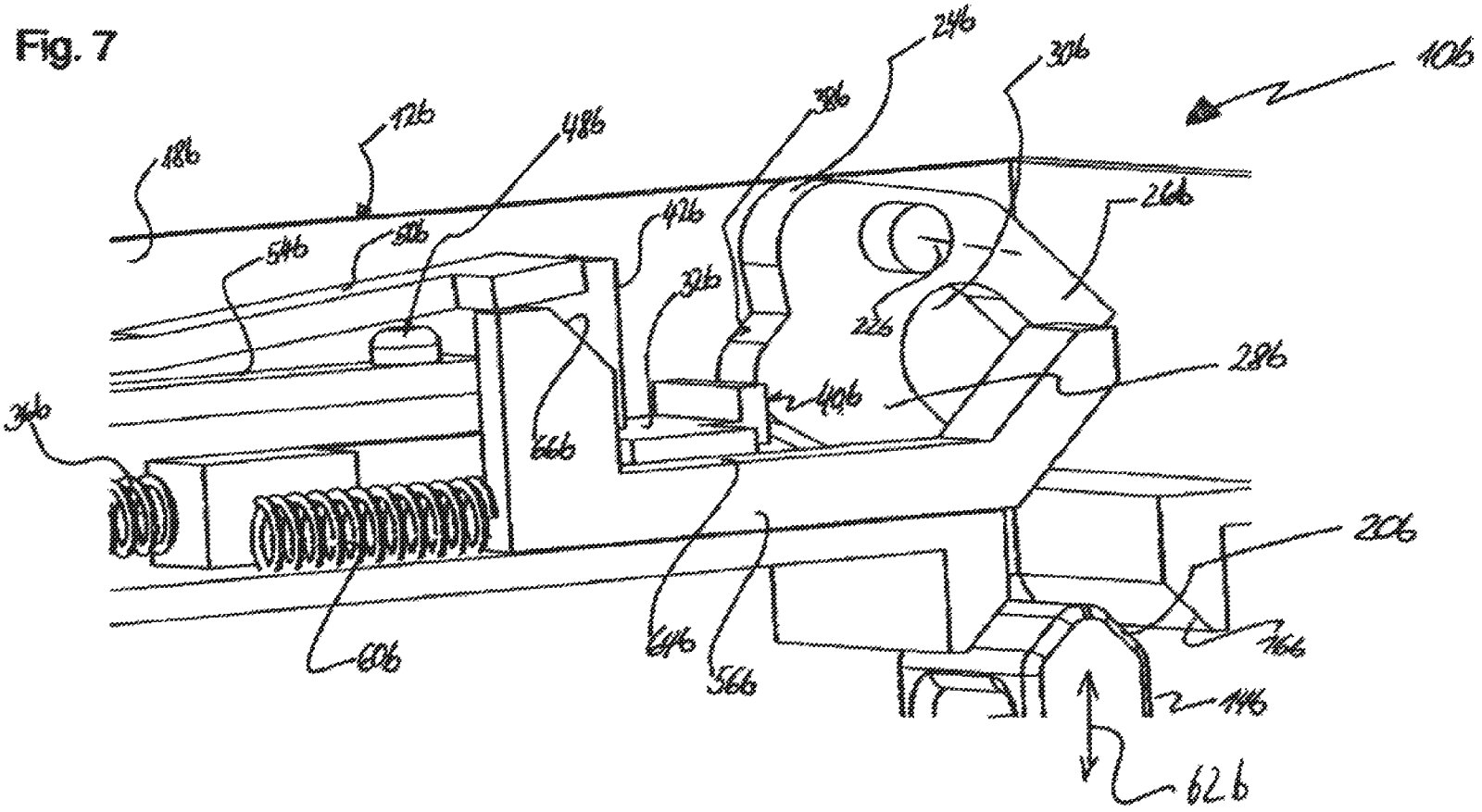
FIG. 7 shows components of a door latch according to a third embodiment, in a situation according to FIG. 1.
Figure 8:
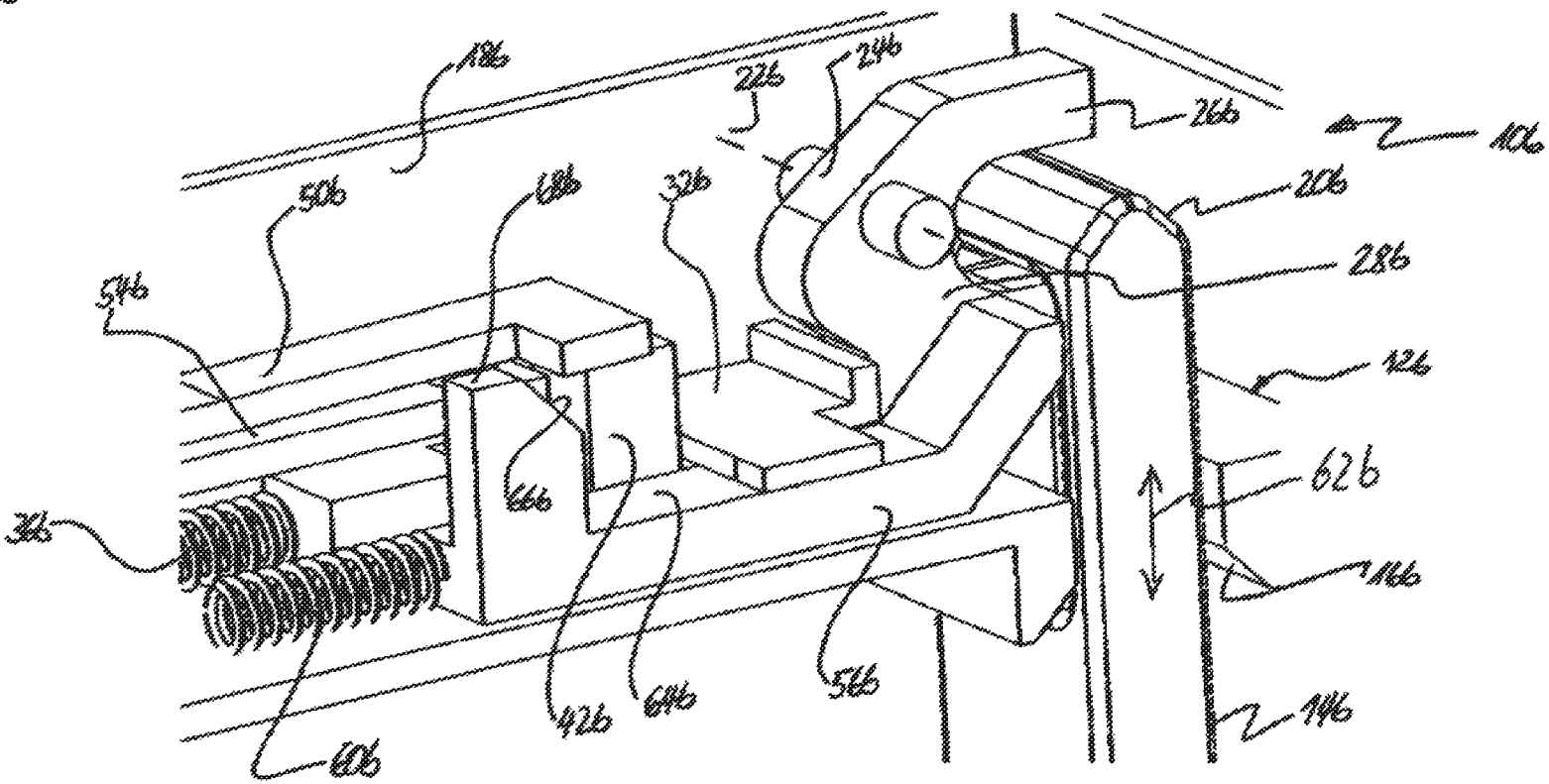
FIG. 8 shows the door latch of FIG. 7 in a situation according to FIG. 2.
Figure 9:
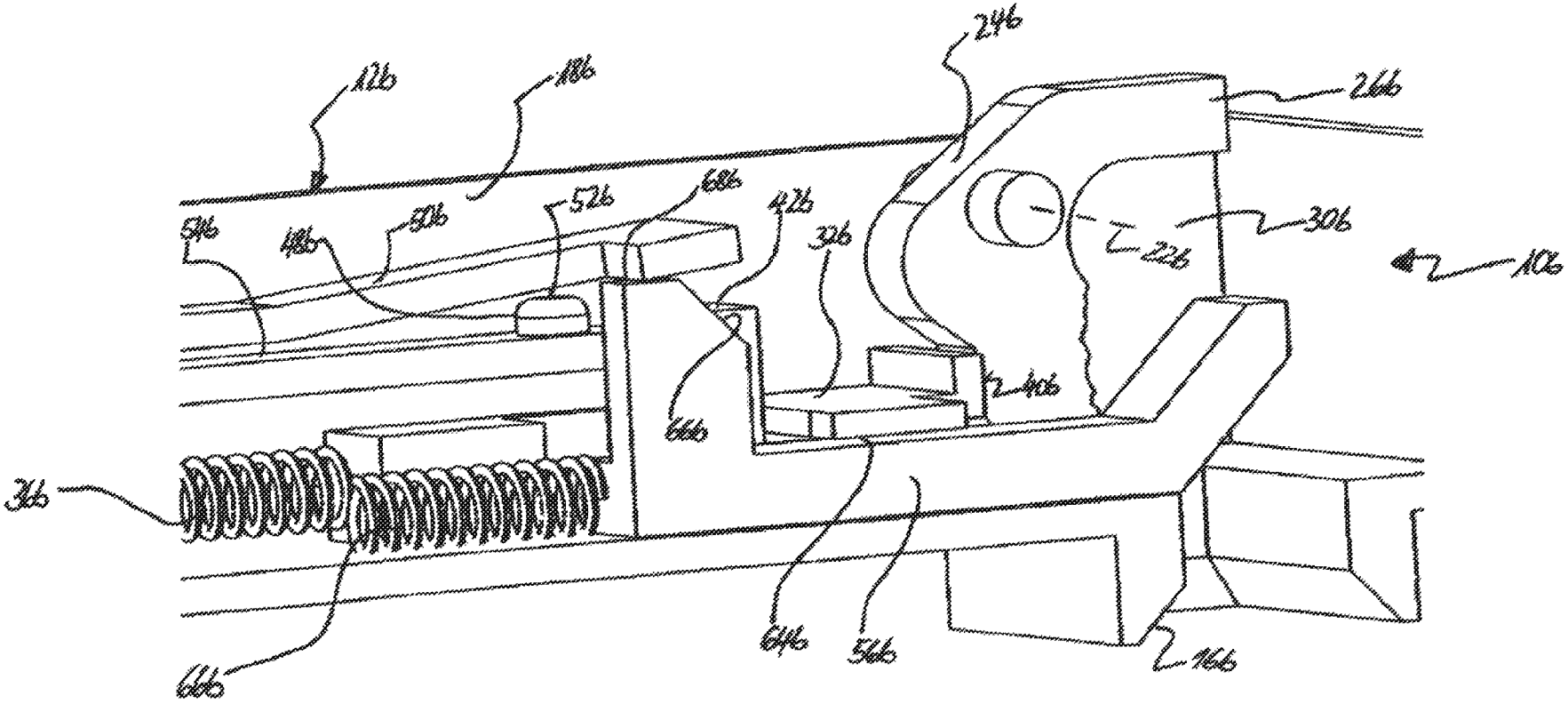
FIG. 9 shows the door latch of FIG. 7 in a situation corresponding to FIG. 3.

While in the first two embodiments the auxiliary slider acts indirectly on the locking switch (in the first embodiment via the locking pin 42 and in the second embodiment via the pusher 72*a*), in the third embodiment according to FIGS. 7 to 9 the auxiliary slider 56*b* acts directly on the locking switch 48*b*. In concrete terms, the leaf spring element 50*b* serves as a path follower which, in the event that the door is opened by force, follows the course of the control ramp 66*b* until the leaf spring element 50*b* comes to lie on the upper path plateau 68*b*. The locking switch 48*b* is thereby opened. A lower path plateau adjacent to the lower end of the control ramp is not required in the example shown; as can be seen in FIG. 8, the leaf spring element 50*b* does not rest on the auxiliary slider 56*b* when the door is closed.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A door latch for a domestic electrical appliance, comprising:

a latch assembly which is configured to hold a closing body in place for holding a door of the domestic appliance closed and to release the closing body for opening of the door, wherein the latch assembly comprising:

a locking element which is arranged to be displaceable between an unlocking position and a locking position;

an arresting element which is arranged to be movable between a release position and an arresting position and which moves from its release position into the arresting position as the door is closed, wherein the arresting element in the arresting position can be locked by means of the locking element against movement into the release position and in the locked state prevents the closed door from opening;

an electric switch which, when the door is closed, responds to a movement of the locking element from the unlocking position into the locking position; and a switch auxiliary control member which is arranged to be movable and which, as the door is closed, is urged by the closing body from an active position against a restoring spring force into an inactive position, wherein the switch auxiliary control member in the active position enforces a first switch state of the electric switch and in the inactive position allows a change in the switch state of the electric switch, wherein the switch auxiliary control member is formed by a slider component which is arranged to be linearly displaceable between the active position and the inactive position and wherein the slider component has a control path that forms an ascending control ramp wherein the switch auxiliary control member when in the active position acts on a contact element forming an electric switch contact of the electric switch by a ramp follower that follows the control path.

2. The door latch according to claim 1, wherein the switch auxiliary control member is arranged to be displaceable in a plane transverse to a direction in which the closing body enters the latch assembly as the door is closed.

3. The door latch according to claim 2 wherein the plane is perpendicular.

4. The door latch according to claim 1 wherein the contact element is a leaf spring.

5. The door latch according to claim 1, wherein the control path forms a first path plateau adjacent to an upper ramp end of the control ramp.

6. The door latch according to claim 5, wherein the control path forms a second path plateau adjacent to a lower ramp end of the control ramp.

7. The door latch according to claim 1, wherein the locking element forms the ramp follower.

8. The door latch according to claim 1, wherein the contact element forms the ramp follower.

9. The door latch according to claim 1, wherein a pusher which is separate from the locking element and which cooperates with the contact element forms the ramp follower.

10. The door latch according to claim 1, wherein the latch group comprises a gripper which is displaceable, while executing a rotational movement, between a release position and a gripping position and which in the gripping position engages behind the closing body in order to hold the door closed and in the release position releases the closing body in order to open the door, and in that the arresting element in its arresting position prevents the gripper from being transferred to the release position.

11. The door latch according to claim 1, wherein the arresting element is a slide component which is arranged to be linearly displaceable or a rotary component which is arranged to be rotatable.

* * * * *